US006273004B1

(12) United States Patent
Klag

(10) Patent No.: US 6,273,004 B1
(45) Date of Patent: Aug. 14, 2001

(54) MOTOR-VEHICLE CARRYING RAILCAR WITH IMPROVED SIDEWALL STRUCTURE

(75) Inventor: James P. Klag, Matteson, IL (US)

(73) Assignee: Thrall Car Manufacturing Company, Chicago Heights, IL (US)

( * ) Notice: Subject to any disclaimer, the term of this patent is extended or adjusted under 35 U.S.C. 154(b) by 0 days.

(21) Appl. No.: 09/324,430

(22) Filed: Jun. 1, 1999

(51) Int. Cl.[7] ..... B61D 17/00

(52) U.S. Cl. ..... 105/404; 105/396; 105/355; 105/401; 105/409; 105/418; 105/411

(58) Field of Search ..... 105/355, 396, 105/401, 409, 418, 419, 404, 411; 312/351

(56) References Cited

U.S. PATENT DOCUMENTS

| | | | | |
|---|---|---|---|---|
| Re. 32,189 | * | 6/1986 | Adler et al. | 105/377 |
| 2,934,371 | * | 4/1960 | Warren | 105/355 |
| 3,801,177 | * | 4/1974 | Fylling et al. | 312/351 |
| 4,889,055 | * | 12/1989 | Jamrozy et al. | 105/355 |
| 5,701,825 | * | 12/1997 | Peach, Jr. | 105/355 |
| 5,765,486 | | 6/1998 | Black, Jr. et al. | 105/410 |
| 5,794,537 | * | 8/1998 | Zaerr et al. | 105/4.1 |
| 5,979,335 | * | 11/1999 | Saxton et al. | 105/404 |

OTHER PUBLICATIONS

U.S. application No. 09/575,895; Inventor(s) Klag et al.; Filed: May 22, 2000.

* cited by examiner

*Primary Examiner*—S. Joseph Morano
*Assistant Examiner*—Frantz F. Jules
(74) *Attorney, Agent, or Firm*—Fitch, Even, Tabin & Flannery

(57) ABSTRACT

A sidewall structure for a motor-vehicle carrying railway car wherein at least one upper deck is supported principally by longitudinal beams that are themselves supported by end structures, without the need for large, heavy vertical posts to support the decks between the end structures. To provide a lightweight car body with sufficient strength and durability for commercial rail service, the car body may be of monocoque construction. Each sidewall preferably has a plate girder structure that employs the horizontal beams as its principal supports, with the beams tied together by sidewall panels or plates. A plurality of light stiffeners may be employed to limit flexure of the sidewalls. Each of the end structures preferably comprises an offset H frame that includes a draft sill joined to a body bolster, and inner and outer cross bearers joined to the draft sill. In the offset H frame, the draft sill slopes downward and inward, with the inner cross bearer being at a lower elevation than the outer one. Vertical posts extend upward at the ends of the cross bearers to support end portions of the longitudinal beams. The ramps may be of compound configuration, comprising a plurality of generally planar segments sloped at varying angles to provide increased bottom clearance for motor vehicle ends during loading and unloading.

20 Claims, 4 Drawing Sheets

MOTOR-VEHICLE CARRYING RAILCAR WITH IMPROVED SIDEWALL STRUCTURE

BACKGROUND OF THE INVENTION

The invention relates generally to railcars, and more particularly to an improved railcar for carrying motor vehicles.

One of the challenges in designing railcars for transportation of motor vehicles is to provide sufficient clearance in the railcar interior to permit the doors of the vehicles to be opened to a sufficient degree that drivers can easily enter and exit the vehicles in the course of loading and unloading operations. In the past, the large, heavy vertical posts that support the upper decks of typical auto rack railway cars have intruded significantly into the interior. The vertical posts, along with cross-braces, knee braces and gussets, restrict available interior clearance for opening of automobile doors, and also restrict movement of workers in the railcar interior. Contact with structural components of the railcar may damage the finish on the doors of new motor vehicles. Door edge protection comprising foam padding or the like is generally applied to the railcar interior to prevent such damage, but has the disadvantage of decreasing the available clearance for opening of the doors.

In recent years, clearance has been improved in certain railcar designs. See, e.g., U.S. Pat. No. 5,765,486. However, there remains room for improvement in this area.

The width and height of railcar bodies are limited by industry regulations, based on spacing between adjacent tracks and clearance required to avoid trackside equipment, signals, tunnels, etc. Interior width is further limited by the need to include sufficient structure in the sidewalls to support one or more upper decks loaded with motor vehicles, and to accommodate the dynamic loads encountered in commercial rail service. In addition to vertical loads due to the weight of the upper decks and the motor vehicles supported thereon, such loads may also include substantial longitudinal impact loads, as well as lateral loads encountered due to rock and roll of the car bodies, and due to travel on nonlinear track configurations. Any effort to provide increased width must take these factors into account.

Another issue encountered in development of railcars for carrying motor vehicles is increasing the vertical dimension of the space available for motor vehicles on each deck. This is of particular interest with respect to tri-level railcars.

To increase vertical clearance on the bottom deck ("A" deck), the deck may have a lowered central portion, with ramps being provided to carry motor vehicles between the lowered central portion and the end portions. It is generally desirable to maximize the length of the lowered central portion of the A deck, and concomitantly to limit the lengths of the ramps. However, if the slope of the ramps is too great, the bottom clearance for the ends of certain motor vehicles may be insufficient.

The invention generally addresses these and other issues relating to increasing interior clearances in railcars for transportation of motor-vehicles.

SUMMARY OF THE INVENTION

The invention provides a novel sidewall structure for a motor-vehicle carrying railway car wherein at least one upper deck is supported principally by longitudinal beams that are themselves supported by end structures, without the need for large, heavy vertical posts to support the decks between the end structures.

The illustrated embodiment comprises a tri-level railcar wherein each sidewall includes first and second longitudinal beams disposed generally parallel to and spaced from each other, connected directly to respective middle and upper decks. The invention might alternatively be embodied in a bi-level car.

To provide a lightweight car body with sufficient strength and durability for commercial rail service, the car body may comprise a monocoque. Each sidewall preferably has a plate girder structure that employs the horizontal beams as its principal supports, with the beams tied together by sidewall panels or plates. A plurality of light stiffeners may be employed to limit flexure of the sidewalls.

Between the end structures, the invention preferably provides an interior width significantly greater than that of conventional auto rack designs.

Novel deck height settings are employed to provide each deck with sufficient vertical clearance to accommodate a variety of different types of motor vehicles. The bottom deck or "A" deck has a lowered central portion. To facilitate loading and unloading of vehicles to and from the central portion of the lower deck, each of the end structures preferably comprises an offset H frame that includes a draft sill joined to a sloped body bolster, and inner and outer cross bearers joined to the draft sill at different elevations. In the offset H-frame, at least a portion of the draft sill slopes downward and inward, with the inner cross bearer being at a lower elevation than the outer one. This arrangement enables a low ramp angle to be employed on the ramp segment between the inner cross-bearer and the central portion of the lower deck without the ramps unduly restricting the length of the lower central portion of the A deck. Vertical posts extend upward at the ends of the cross bearers to support end portions of the longitudinal beams.

The ramps may be of compound configuration, comprising a plurality of generally planar segments sloped at varying angles to provide increased bottom clearance for motor vehicle ends during loading and unloading.

DETAILED DESCRIPTION OF THE PREFERRED EMBODIMENT

Figure 1:
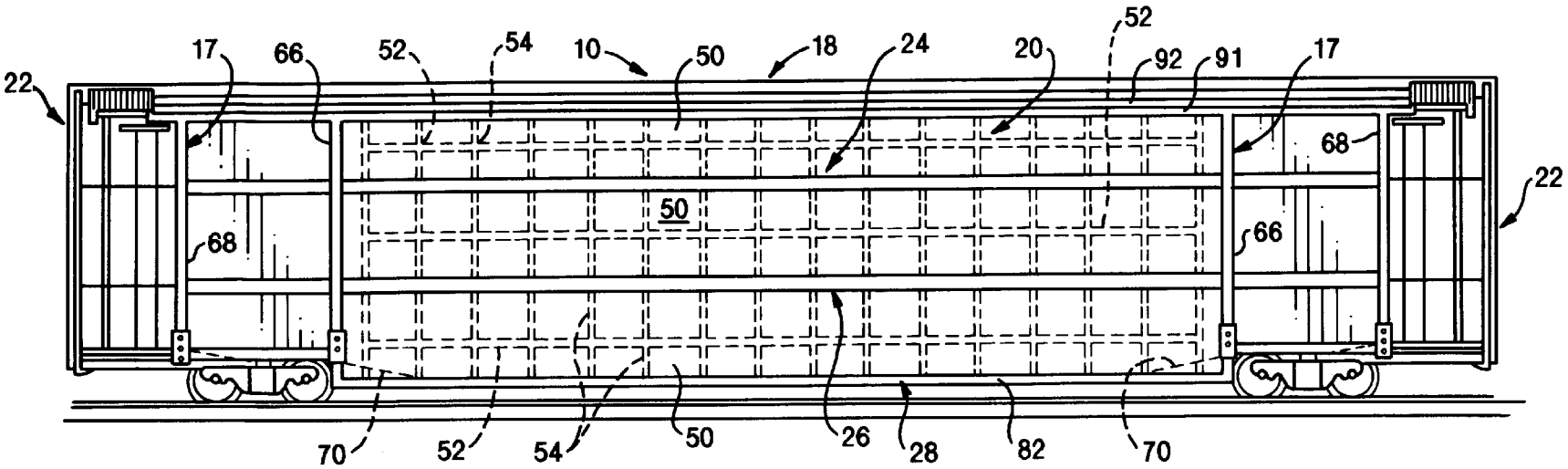
FIG. 1 is a side-elevational view of a railcar in accordance with a preferred embodiment of the invention.

The invention is generally embodied in a railway car 10 for transporting motor vehicles. In the illustrated embodiment, the car comprises a single unit. However, it should be appreciated that the invention might alternatively be embodied in an articulated railway car comprising two or more units.

In the illustrated embodiment, the car includes a floor or "A" deck 12, a second deck or "B" deck 14, and a third deck or "C" deck 16. A roof 18 extends over the top of the railcar. The interior of the car is substantially enclosed by sidewalls 20 and end doors 22.

While the illustrated embodiment comprises a tri-level railcar, it should be appreciated that the invention might alternatively be embodied in a bi-level railcar.

In the past, railway cars for transporting motor vehicles generally have relied upon large, heavy vertical posts to support one or more upper decks along the length of the railcar. In accordance with the illustrated embodiment of the invention, the upper decks 14 and 16 of the railcar 10 are supported between end structures 17 by upper and lower longitudinally extending beams 24 and 26, rather than by large, heavy vertical posts.

The vertical posts used in the past reduce the interior width. In the illustrated embodiment of the invention, increased interior width is maintained along the length of a central portion 28 of the railcar, for a substantial portion of the height of the loading area above each deck, by elimination of such posts.

Figure 4:
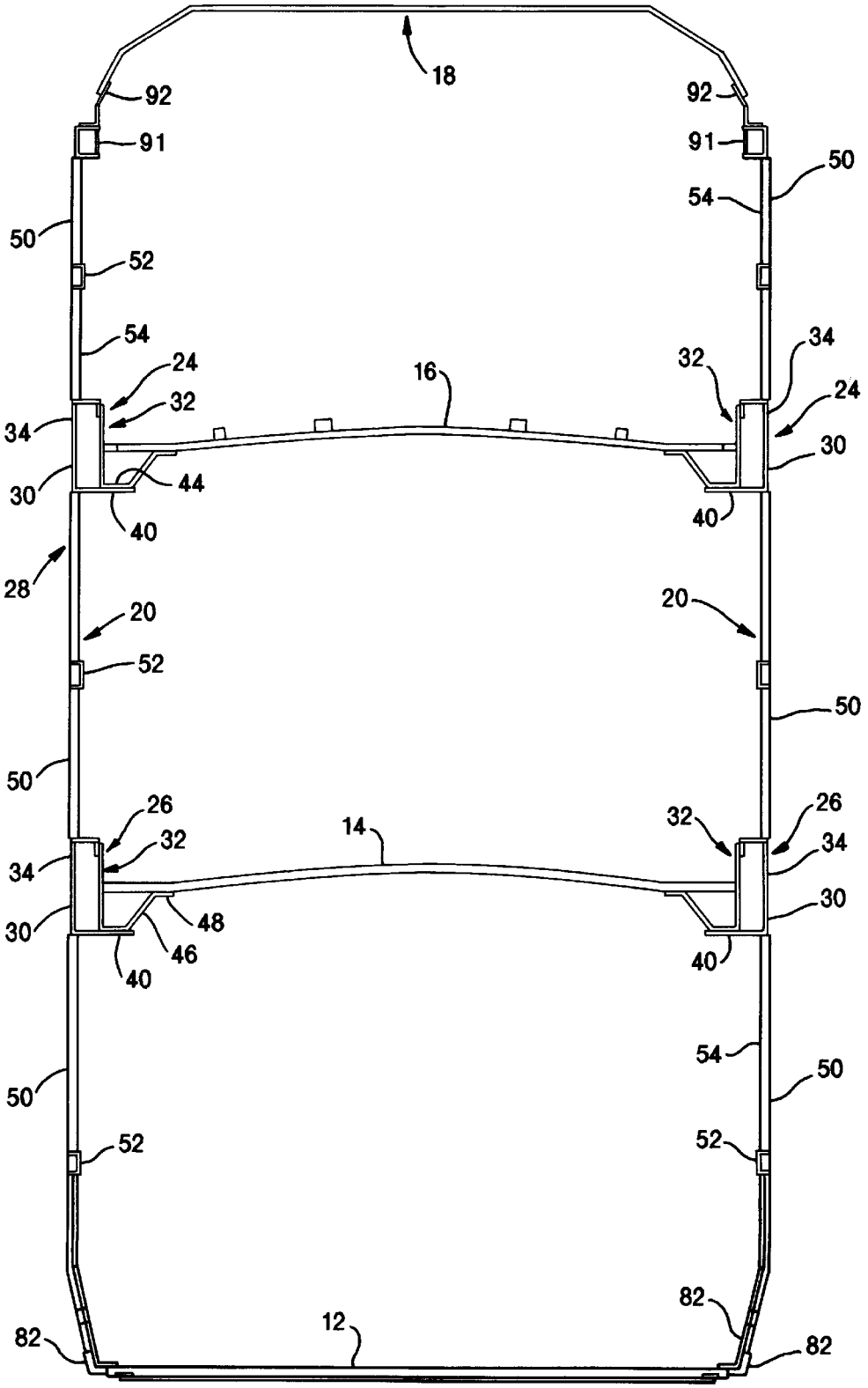
FIG. 4 is a transverse sectional elevational view of a central portion of the railcar of FIG. 1.

As shown in FIGS. 1 and 4, each sidewall of the railcar includes upper and lower longitudinal beams 24 and 26 disposed generally parallel to and spaced from one another, connected directly to the B and C decks. Each of the beams is configured to provide support to its associated deck without unnecessarily reducing interior clearances, and without unduly increasing the weight of the railcar. In addition, the beams are intended to be capable of economical manufacture so as to be suitable for use in commercial mass production of railcars. While various different beam configurations might satisfy these criteria, the illustrated beam configuration is described in detail below for purposes of example.

Each beam in the illustrated embodiment is preferably composite i.e., it comprises a plurality of longitudinally coextensive sections. Each beam further comprises a hollow, generally rectangular outer portion 94 and an inwardly extending portion 96 that is joined to the deck to form an elongated hollow structure of generally trapezoidal shape.

Turning to a more detailed description of the illustrated embodiment, each of the illustrated beams comprises outer and inner sections 30 and 32. The outer section has a narrow profile, with its vertical dimension being substantially greater than its width. The outer section comprises a vertical outer web 34, a horizontal top wall 36, a vertical inner flange 38 depending from the top wall 36, and a horizontal bottom wall 40 extending inward from the bottom of the outer web. The inner section 32 comprises a vertical web 42, a horizontal bottom wall 44, extending inward therefrom, an angled support wall 46 extending inward and upward from the bottom wall 44 to engage the bottom of the deck, and a flange 48 extending inward along the bottom of the deck. Each of the inner and outer sections is preferably an integral, unitary, one-piece rolled steel member.

Figure 6:
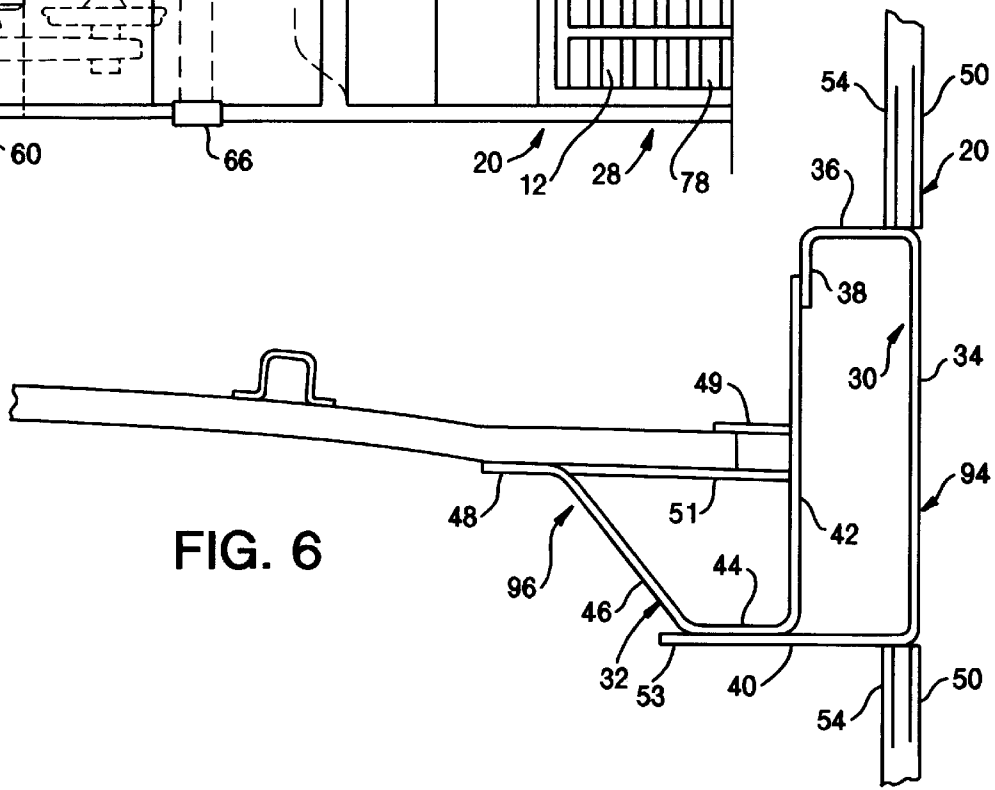
FIG. 6 is a fragmentary transverse sectional elevational view of the edge of a deck of the railcar.

In the illustrated embodiment, the bottom wall 44 of the inner section overlies a portion of the bottom wall 40 of the outer section and is welded continuously thereto. An upper portion of the web 42 of the inner section overlaps the flange 38 of the outer section and is welded continuously thereto. As shown in FIG. 6, the inner section further includes a closure plate 51 extending inward from the inner web 42 to the bottom of the deck. The closure plate 51 preferably extends inward to the inner flange 48, cooperating with web 42 and walls 44 and 46 to form a closed tube. A flange 49 may extend from the inner web 42 to the top of the deck as an alternative to, or in addition to the closure plate 51. The closure plate and/or the flange may be welded to both the web 42 and the deck.

To facilitate welding of the inner section 32 to the outer section 30, the bottom wall 40 of the outer section preferably extends inward beyond the bottom wall 44 of the inner section, defining an inner lip or ledge 53 beneath a portion the angled wall 46.

The beams 24 and 26 preferably have sufficient strength to support the weight of the loaded decks without relying upon large, heavy vertical support posts between the end structures 17. To provide the beams 24 and 26 with sufficient strength, they maybe rolled from, e.g., ⅜ in. or 5/16 in steel.

The outer surface of the side wall is preferably devoid of footholds that would facilitate climbing of the side wall of the car. To this end, the outer surface of the outer web 34 preferably is substantially coplanar with the outer surface of the surrounding sidewall structure.

Each sidewall preferably has a plate girder construction that employs the horizontal beams as its principal supports. In the illustrated embodiment, the beams 24 and 26 are joined to sidewall panels or plates 50 and a plurality of light vertical and horizontal stiffeners 54 and 52. The plates may have openings formed therein for light and ventilation. To eliminate the need for the many mechanical fasteners used in typical prior art auto racks, the preferred sidewalls are of welded construction, with all joints between the various components being welded. The illustrated stiffeners comprise channel members continuously welded along their lengths to the interiors of the sidewall plates, with the vertical channels 54 being welded at their ends to the longitudinal beams 24 and 26. To limit their intrusion into the railcar interior while still providing sufficient strength, the stiffeners 52 and 54 preferably have a transverse dimension of no more than about 1 ½ in. and the sidewall plates 50 have a preferred thickness less than ¼ in., preferably between about 0.11 and 0.15 in. In the preferred embodiment, the sidewall plates are substantially flat or planar, in contradistinction to the corrugated sidewall panels commonly used in the past, and are made of 9, 10, and 11 gauge steel plates or sheets, having nominal thickness of about 0.1196, 0.1345 and 0.1495 in. respectively. The A deck sidewall plates are 9 gauge plates; the B deck, 10 gauge; and the C deck, 11 gauge. In the preferred embodiment the stiffeners 52 and 54 are standard 4 in. steel channels, i.e., channels having a width of about 4 in., a flange dimension of about 1½ in., and a weight of about 5.4 lbs./ft. In other embodiments other stiffeners may be employed, e.g., 3 in. channels, herein 4 in. channels, or stiffeners of other cross-sections. Also, the sidewall plates might be of uniform thickness, e.g., all three decks might employ 11 gauge steel plates.

In contrast to typical prior art auto rack railcars, the railcar 10 includes top chords along the upper edges of the sidewalls. Top chords 91 and roof rails 92 extend along the upper ends of the sidewalls 20, and side sills 82 extend along the lower ends.

Figure 7:
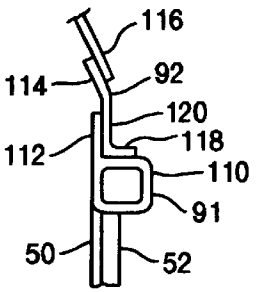
FIG. 7 is a sectional view of a top chord and roof rail of the railcar.

As shown in FIG. 7, each top chord 91 preferably has a generally b-shaped cross section, comprising a lower tubular section 110 of rectangular, square cross-section with a flange 112 extending upward along one side. The roof rail 92 has a generally L-shaped cross-section, comprising a horizontal flange 118 and a vertical web 120, and is seated on the top of the top chord, abutting the flange 112 and the top wall of the tubular section 110. An upper edge portion 114 of the roof rail web is angled inward to join a sloped edge portion 116 of the roof. The top chord preferably functions as a structural member of the plate grinder construction of the sidewall between the end structures 17. The top chord 91 preferably extends continuously along the top of the sidewall 20, and preferably comprises a single continuous member welded to vertical stiffeners 52 and sidewall panels 50.

In other embodiments, the sidewalls might have other configurations. For example, instead of the illustrated grid of stiffeners, stiffness might be provided by diagonal members, or by vertical members only. Alternatively, the sidewall panels 50 themselves might be made sufficiently strong to eliminate the need for additional stiffeners, e.g., by increasing their thickness, or by making the sidewall panels of nonplanar configuration, as by incorporating ribs or other integral structure to add rigidity.

Each of the end structures 17 preferably comprises an offset H frame 56 that includes a longitudinally extending draft sill 58 coupled to a body bolster 60, and inner and outer cross bearers 62 and 64 respectively coupled to the draft sill. In the offset H frame, the draft sill slopes downward and inward, with the inner cross bearer 62 being at a lower elevation than the outer one. Inner and outer vertical posts 66 and 68 extend upward at each end of each cross bearer to support the longitudinal beams.

Between the end structures 17, the central portion 28 of the railcar preferably has an interior width of slightly over 9 feet, 7 inches, which is more than 6 inches greater than the corresponding width in conventional prior art auto rack designs.

The side sills 82 extend along the bottom side edges of the car body between the inner crossbearers 62. The side sills may comprise, e.g. heavy steel angles or other elongated members. In one particular embodiment, the side sills are angles of ½-inch thickness.

The side sills transmit draft and buff loads along the central portion of the car. Draft and buff loads are transmitted to the side sills from the draft sill 58 through the inner cross bearer 62, the body bolster 60, one or more of the floor plates 84, 86 and 88, which may act as shear plates, and upper side sill extensions 90.

Figure 3:
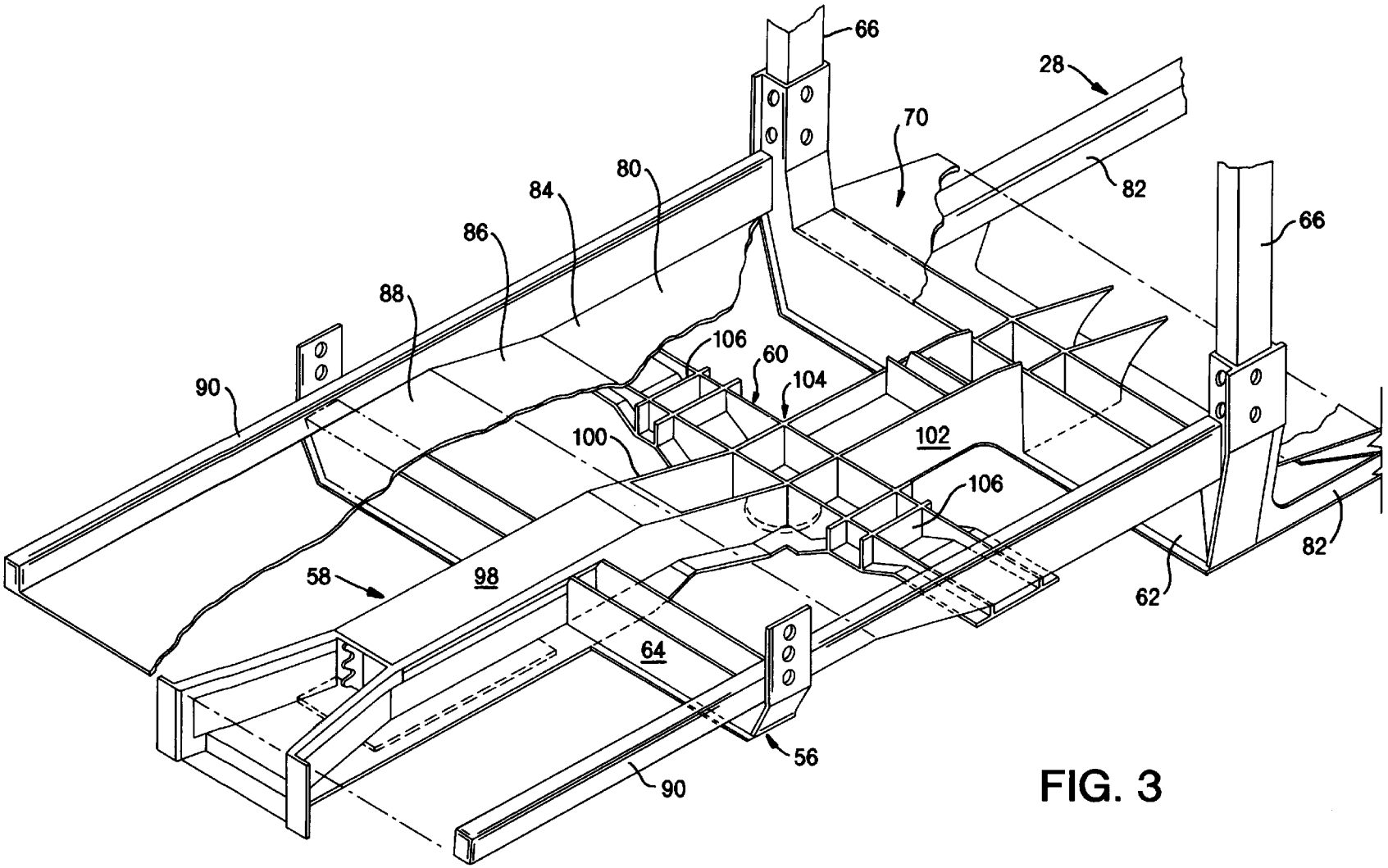
FIG. 3 is a perspective view illustrating the end structure of FIG. 2.

As shown in FIG. 3, the draft sill 58 has a substantially horizontal segment 98 at an appropriate elevation for support of draft gear compatible with that of other railcars, a downwardly sloping intermediate segment 100, and a generally horizontal inner segment 102. The bottom of the draft sill curves downward at its inner end to join the bottom wall 108 of the inner cross bearer, which functions as a shear plate to transmit draft and buff loads to the side sills 82.

The illustrated body bolster 60 is integrated with the draft sill 58 to some extent in that a central portion of the body bolster 60 comprises a portion 104 of the inner segment 102 of the draft sill. The body bolster 60 shown in FIG. 3 has a pair of arms 106 to support side bearings, and in the illustrated embodiment extends to the side sill extensions 90 and is welded thereto. In other embodiments, the width of the body bolster may be reduced, e.g., it may extending only as far as necessary to support the side bearings, without extending the full width of the railcar.

In the preferred embodiment, the floor plate 84 over the inner segment 102 of the draft sill functions as a shear plate, and is joined to the top of the body bolster. To enable the floor plate 84 to withstand the shear stresses and other loads encountered during use, the floor plate 84 is preferably a heavy steel plate. For example, a ⅜-inch plate may be employed.

To increase the clearance available for vehicles being loaded and unloaded from the A deck, end portions of the B deck 14 are upwardly pivotable. Increased vertical clearance is also provided by the offset H frame, and specifically by the downward sloping segment of the draft sill, and by the placement of the inner cross bearer at a lower elevation than the outer cross bearer.

Figure 5:
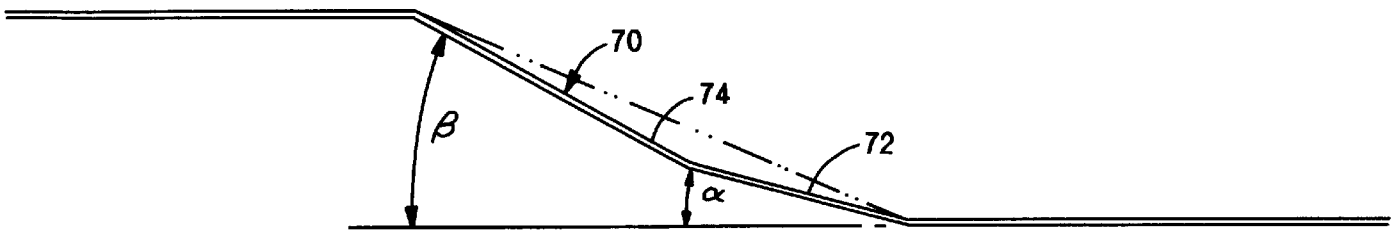
FIG. 5 is a schematic elevational view of a ramp of the railcar of FIG. 1.
Figure 2:
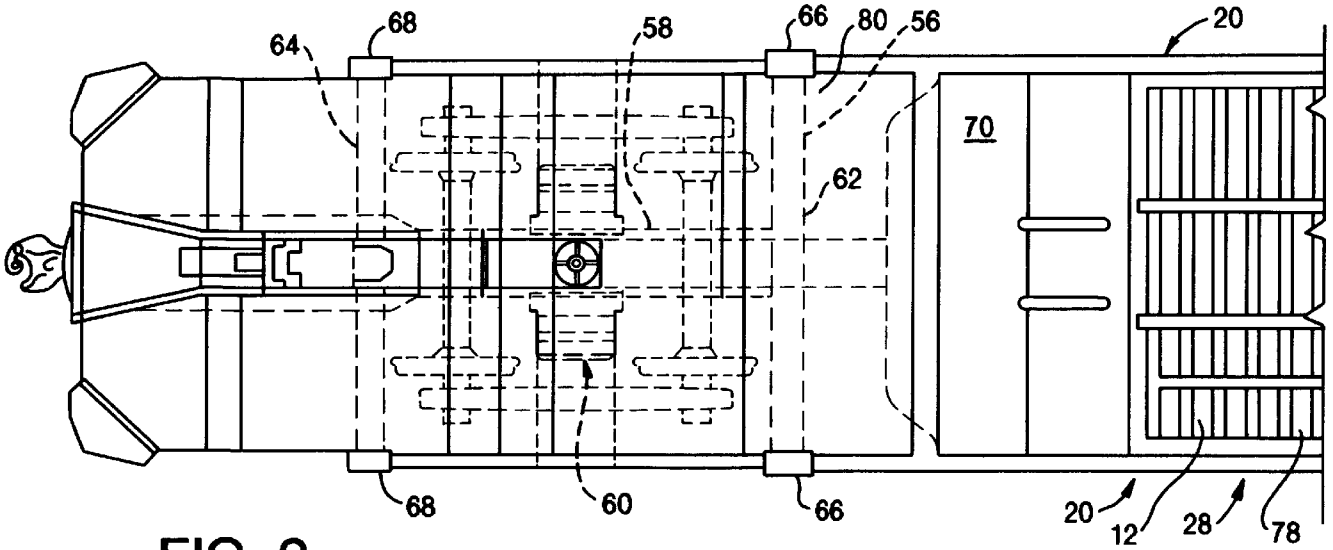
FIG. 2 is an enlarged schematic plan view of an end of the railcar of FIG. 1.

As shown in FIG. 1, inclined ramps 70 facilitate loading of motor vehicles on the A deck, and specifically, facilitate movement of vehicles between the lower, central portion 78 of the A deck and the upper end portions 80 the trucks. To avoid clearance problems between the ends of the vehicles and the ramps as the vehicles transition on and off of the ramps, each ramp preferably includes a compound inclined configuration, with a first or lower portion 72 of the ramp being inclined at a first angle , and a second portion 74 of the ramp being inclined at a second angle β to the horizontal. As shown in FIG. 5, the second angle β is greater than the first angle , so that a vehicle first encounters a relatively shallow incline as it begins travel up the ramp, then encounters a greater incline when its tires contact the second portion of the ramp. In other embodiments, the ramp may include one or more additional portions inclined at other angles. Each portion of the ramp in the illustrated embodiment is substantially linear. That is, each portion slopes at a substantially constant angle over its length.

In the illustrated embodiment, the compound ramp has its lower portion inclined at an angle of 5 degrees, and its upper portion at an angle β of about 10 degrees.

The deck elevations of the railcar preferably are selected to provide sufficient vertical clearance to accommodate a wide variety of vehicles, including full size automobiles and minivans.

In the preferred embodiment, each deck has at least about six feet of vertical clearance. At the upper (end) portions of the A deck, the clearance may be less than six feet when the ends of the B deck are in their lowered positions for use, but the lower (central) portion of the A deck preferably has a vertical clearance greater than six feet.

The lower portion of the A deck preferably is about one foot above top of rail. The B deck is preferably about seven feet above the lower portion of the A deck, and the C deck is preferably about 6 feet above the B deck. The overall height of the car (above top of rail) is about 20 feet. In the preferred embodiment, the deck elevations above the top of the rail measured at the upper surface of the deck, at centerline of the car, midway between the side walls, are as follows: lower A deck, 1'½"; B deck, 8'½"; C deck, 14'11/16". The overall height of the car above top of rail is about 20'1¾". In other embodiments, the deck elevations may be the same as those of conventional tri-level railcars manufactured in the past, or at other elevations suited to transport of particular vehicles.

From the foregoing, it should be appreciated that the invention provides a novel and improved railcar design. The railcar is believed to be capable of carrying motor vehicles in commercial rail service, and the structure is believed to be capable of withstanding several years of service without suffering undue wear or damage due to fatigue. The invention is further described and particularly pointed out by the following claims.

What is claimed is:

1. A motor vehicle carrying railcar comprising a pair of upstanding sidewalls, a lower deck and at least one upper deck capable of carrying a plurality of motor vehicles in commercial rail service, said railcar further comprising a pair of trucks, first and second end structures disposed over the trucks, and a central portion between said end structures, said upstanding sidewalls including a pair of longitudinal beams extending along opposite sides of said at least one upper deck, said upper deck having a central portion between said end structures supported principally by said sidewalls without relying on vertical posts to support the weight of the loaded decks between said end structures.

2. A motor vehicle carrying railcar in accordance with claim 1 wherein said upper deck is immediately adjacent said longitudinal beams and connected directly thereto, without intermediate vertical posts.

3. A motor vehicle carrying railcar in accordance with claim 1 wherein said upstanding side walls comprise plate girder structures.

4. A motor vehicle carrying railcar in accordance with claim 1 wherein said pair of sidewalls are spaced from one another by at least about 9'2" over a substantial portion of the height of the sidewalls along substantially the entire length of said central portion.

5. A motor vehicle carrying railway car in accordance with claim 1 wherein said central portion includes a pair of sidewalls spaced from one another by at least about 9'6" over a substantial portion of the height of the sidewalls along the entire length of said central portion.

6. A motor vehicle carrying railcar in accordance with claim 1 wherein each of said upstanding sidewalls includes a top chord and a roof rail extending along its upper end, and a side sill extending along its lower end, along substantially the entire length of said central portion.

7. A railcar capable of transporting a plurality of motor vehicles in commercial rail service, said railcar including a body comprising a floor, a pair of upstanding side walls, a pair of end structures, and at least one upper deck spaced above the floor of the railcar so that motor vehicles may be supported on at least two levels;

said upstanding side walls comprising plate girder structures including longitudinal beams supported by said end structures;

said at least one upper deck having a central portion supported by said longitudinal beams such that loads on said central portion are supported by said sidewalls without relying on vertical posts to support the weight of the loaded decks between said end structures.

8. A motor vehicle carrying railcar in accordance with claim 7 wherein said upper deck is immediately adjacent said longitudinal beams and connected directly thereto, without intermediate vertical posts.

9. A motor vehicle carrying railcar in accordance with claim 8 wherein said pair of sidewalls are spaced from one another by at least about 9'2" over a substantial portion of the height of the sidewalls along substantially the entire length of said central portion.

10. A motor vehicle carrying railway car in accordance with claim 8 wherein said central portion includes a pair of sidewalls spaced from one another by at least about 9'6" over a substantial portion of the height of the sidewalls along the entire length of said central portion.

11. A motor vehicle carrying railway car in accordance with claim 8 wherein said railcar body comprises a monocoque including said sidewalls.

12. A motor vehicle carrying monocoque railcar body comprising a pair of end structures, a pair of upstanding sidewalls, a lower deck and at least one upper deck capable of carrying a plurality of motor vehicles, wherein said sidewalls include beams extending along a substantial portion of at least one upper deck to support said at least one upper deck between said end structures without relying on vertical posts to support the weight of the loaded decks between said end structures.

13. A motor vehicle carrying railcar in accordance with claim 12 wherein each of said beams is of composite construction, comprising a plurality of substantially coextensive elongated sections joined together.

14. A motor vehicle carrying railcar in accordance with claim 13 wherein each of said beams includes a tubular outer section of generally rectangular cross-section, and a tubular inner section of generally trapezoidal cross-section.

15. A motor vehicle carrying railcar in accordance with claim 14 wherein said upstanding sidewalls are plate girder structures.

16. A motor vehicle carrying railcar in accordance with claim 15 wherein each of said upstanding sidewalls includes a top chord and a roof rail extending along its upper end, and a side sill extending along its lower end.

17. A motor vehicle carrying railcar body comprising a pair of upstanding sidewalls, a lower deck and at least one upper deck capable of carrying motor vehicles, wherein said sidewalls include beams extending along a substantial portion of at least one upper deck to support said at least one upper deck, wherein each of said beams is of composite construction, comprising a plurality of substantially coextensive elongated sections joined together, said sections including a tubular outer section of generally rectangular cross-section, and a tubular inner section of generally trapezoidal cross-section.

18. A motor vehicle carrying railcar in accordance with claim 17 wherein said upstanding sidewalls are plate girder structures.

19. A motor vehicle carrying railcar in accordance with claim 18 wherein each of said upstanding sidewalls includes a top chord and a roof rail extending along its upper end, and a side sill extending along its lower end.

20. A motor vehicle carrying railway car in accordance with claim 19 wherein said railcar body comprises a monocoque including said sidewalls.

* * * * *